US010914265B2

(12) United States Patent
Yarino

(10) Patent No.: US 10,914,265 B2
(45) Date of Patent: Feb. 9, 2021

(54) CYLINDER HEAD

(71) Applicant: TOYOTA JIDOSHA KABUSHIKI KAISHA, Toyota (JP)

(72) Inventor: Motonari Yarino, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/571,637

(22) Filed: Sep. 16, 2019

(65) Prior Publication Data

US 2020/0132013 A1 Apr. 30, 2020

(30) Foreign Application Priority Data

Oct. 29, 2018 (JP) ..... 2018-203083

(51) Int. Cl.

| | |
|---|---|
| ***F01P 3/02*** | (2006.01) |
| ***F02F 1/10*** | (2006.01) |
| ***F02F 1/42*** | (2006.01) |
| *F02B 75/18* | (2006.01) |

(52) U.S. Cl.

CPC ..... *F02F 1/4214* (2013.01); *F02F 1/4235* (2013.01); *F02B 2075/1816* (2013.01)

(58) Field of Classification Search

CPC ..... F01P 3/02; F01P 2003/024; F01P 3/16; F01P 3/14; F01P 3/00; F02F 1/40; F02F 1/10; F02F 1/4214; F02F 1/4285; F02F 1/36

See application file for complete search history.

(56) References Cited

U.S. PATENT DOCUMENTS

| | | | | |
|---|---|---|---|---|
| 6,481,392 | B1 * | 11/2002 | Etemad | F02F 1/108 123/41.74 |
| 2004/0040521 | A1 * | 3/2004 | Hardin | F02F 1/40 123/41.82 R |
| 2005/0139191 | A1 * | 6/2005 | Tanaka | F02B 23/101 123/302 |
| 2005/0139195 | A1 * | 6/2005 | Kuriki | F02F 1/4235 123/432 |
| 2005/0252463 | A1 * | 11/2005 | Matsui | F02F 1/40 123/41.82 R |
| 2009/0260588 | A1 * | 10/2009 | Hong | F02F 1/40 123/41.82 R |

(Continued)

FOREIGN PATENT DOCUMENTS

| | | |
|---|---|---|
| JP | 2000-329001 A | 11/2000 |
| JP | 2017-057824 A | 3/2017 |

*Primary Examiner* — Long T Tran
(74) *Attorney, Agent, or Firm* — Oliff PLC

(57) ABSTRACT

In a cylinder head according to an example of the present disclosure, a pair of intake ports communicating with the common combustion chamber are formed so that the wall thickness of the port walls on opposing sides is relatively small and the wall thickness of the port walls on reversing sides is relatively large. Herein, the opposing side is the side on which the port walls of the pair of the intake ports face each other. The reversing side is the side opposite to the opposing side. That is, the reversing side is the side on which the port walls of the pair of the intake ports face away from each other. An inter-ports flow path for flowing the cooling water is formed between the port walls on the opposing sides of the pair of the intake ports.

4 Claims, 9 Drawing Sheets

(56) References Cited

U.S. PATENT DOCUMENTS

| | | | | |
|---|---|---|---|---|
| 2014/0305400 | A1* | 10/2014 | Berger | F02F 1/40<br>123/193.6 |
| 2017/0335744 | A1* | 11/2017 | Konishi | F02B 75/22 |
| 2018/0223768 | A1* | 8/2018 | Miura | F02F 1/40 |
| 2019/0003416 | A1* | 1/2019 | Sugimoto | F01P 3/16 |
| 2019/0195166 | A1* | 6/2019 | Sakata | F02F 1/38 |
| 2019/0195167 | A1* | 6/2019 | Sakata | F02F 1/40 |

* cited by examiner

CYLINDER HEAD

CROSS-REFERENCE TO RELATED APPLICATION

The present application claims priority under 35 U.S.C. § 119 to Japanese Patent Application No. 2018-203083, filed Oct. 29, 2018. The contents of this application are incorporated herein by reference in their entirety.

BACKGROUND

Field

The present disclosure relates to a cylinder head of an internal combustion engine, and more particularly, to a cylinder head including a pair of intake ports communicating with a common combustion chamber.

Background

In a water-cooled internal combustion engine, a flow path for cooling water is formed in a cylinder head. By forming the flow path of the cooling water in the vicinity of an intake port and cooling the wall surface of the intake port, occurrence of knocking may be suppressed. Also, charging efficiency may be improved by decrease of intake air temperature. Further, when a pair of intake ports communicating with a common combustion chamber are provided in a cylinder head, cooling efficiency may be enhanced by flowing cooling water also between the intake ports.

JP 2000-329001 A discloses a configuration of a cylinder head for securing a flow rate of cooling water flowing between intake ports. In the cylinder head disclosed in JP 2000-329001 A, the interval between the openings of the intake ports is widened, and the opening diameter of the intake ports is set relatively smaller than that of a general four-valve type internal combustion engine.

However, if the opening diameter of the intake port is reduced, the amount of intake air is reduced and, as a result, efficiency and output may is reduced. Therefore, in the cylinder head disclosed in JP 2000-329001 A, the intake ports are formed as tangential ports having a small intake resistance in order to prevent the efficiency and the output from reducing. Also, in JP 2000-329001 A, the lift amount of intake valve is increased so that actual cross-sectional area of an intake passage is increased.

SUMMARY

The configuration of the cylinder head disclosed in the above-mentioned document is not applicable to all internal combustion engines. Generally, in order to increase the intake air amount, opening diameter of intake port should be larger. However, when the opening diameter of the intake port is increased, the interval between the intake ports becomes narrow. As a result, it becomes difficult to secure the flow rate of cooling water flowing between the intake ports. In order to merely secure the flow rate of the cooling water, the space of flow path of the cooling water may be secured by reducing wall thickness of the port wall. However, it becomes difficult to secure the strength enough to withstand the explosive stress, the thermal stress, and the like from a combustion chamber.

The present disclosure has been conceived in consideration of the above-mentioned problems, and an object of an example in the present disclosure is to provide a cylinder head that secures a flow path for flowing cooling water between a pair of intake ports communicating with a common combustion chamber while maintaining an opening diameter and strength of the pair of the intake ports.

In a cylinder head according to an example of the present disclosure, a pair of intake ports communicating with the common combustion chamber are formed so that the wall thickness of the port walls on opposing sides is relatively small and the wall thickness of the port walls on reversing sides is relatively large. The opposing side is the side on which the port walls of the pair of the intake ports face each other. The reversing side is the side opposite to the opposing side. That is, the reversing side is the side on which the port walls of the pair of the intake ports face away from each other. An inter-ports flow path for flowing the cooling water is formed between the port walls on the opposing sides of the pair of the intake ports. According to the cylinder head configured as described above, the cross-sectional area of the inter-ports flow path is increased while maintaining the opening diameter of the intake port by making the wall thickness of the port wall on the side facing each other relatively thin. In addition, the strength of the intake port can be maintained by relatively increasing the wall thickness of the port walls on the sides facing away from each other.

One intake passage may bifurcates in the cylinder head to form a pair of intake ports. It is preferred to flow the cooling water into the gap between the crotch of the intake passage branched into the pair of the intake ports and the combustion chamber. According to the cylinder head of the example in the present disclosure, it is possible to form the inter-ports flow path having a large cross-sectional area in the gap between the crotch of the intake path and the combustion chamber.

The wall thickness of the each port wall of the pair of the intake ports may gradually increase from the opposing side to the reversing side. According to this configuration, it is possible to prevent stress concentration.

When the injector insertion hole communicating with the combustion chamber is located between the pair of the intake ports and the cylinder block mating surface, the wall thickness of the hole wall of the injector insertion hole on the side facing the pair of the intake ports may be thinner than the wall thickness of the hole wall on the side facing away from the pair of the intake ports. A communication passage for introducing the cooling water into the inter-ports flow path may be formed between the pair of the intake ports and the injector insertion hole. According to this configuration, it is possible to secure a flow path for flowing the cooling water in the inter-ports flow path.

As described above, according to the cylinder head of the example in the present disclosure, it is possible to secure the flow path for flowing the cooling water between the intake ports while maintaining the opening diameters and strengths of the pair of the intake ports communicating with the common combustion chamber.

DESCRIPTION of EMBODIMENTS

Embodiments in the present disclosure will be described with reference to the drawings. However, the following embodiments exemplify apparatuses and methods for embodying the technical idea of the present disclosure.

First Embodiment

The first embodiment in the present disclosure will be described with reference to the drawings.

Figure 1:
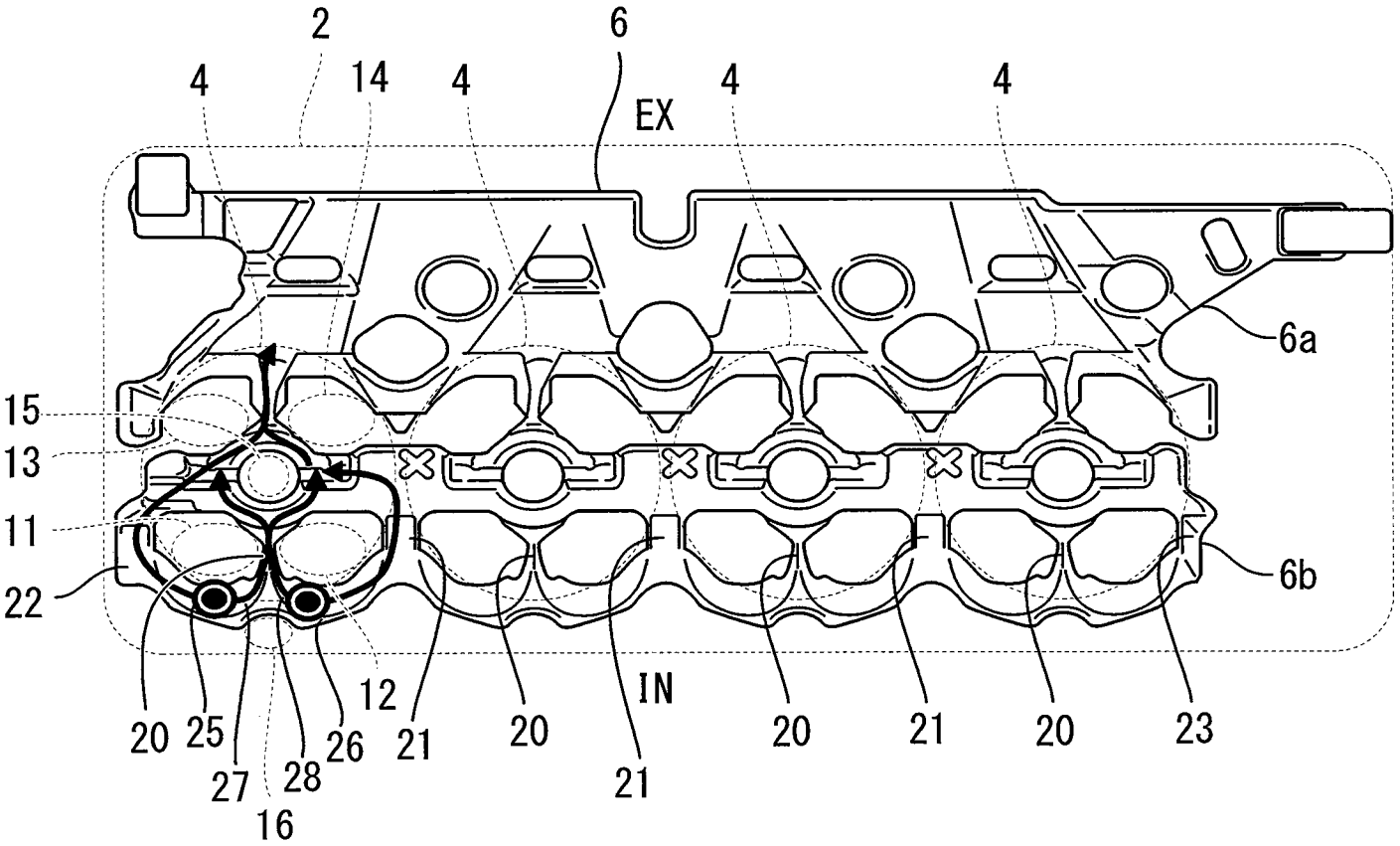
FIG. 1 is a perspective plan view of a water jacket of a cylinder head according to a first embodiment in the present disclosure.

FIG. 1 is a perspective plan view of a water jacket of a cylinder head according to the first embodiment in the present disclosure. An internal combustion engine to which the cylinder head 2 of the present embodiment is applied is a spark ignition type water-cooled in-line four cylinder engine. The internal combustion engine is a natural intake type engine without a supercharger. Further, the internal combustion engine is a side injection type direct injection engine provided with a direct injection injector which is disposed below an intake port. The direct injection injector directly injects fuel into a combustion chamber. However, the internal combustion engine to which the cylinder head according to examples in the present disclosure is applied is not limited to its specification except that it is a water-cooled engine including a pair of intake ports communicating with a common combustion chamber.

In the cylinder head 2, four combustion chambers 4 for four cylinders are formed in line at equal intervals in the longitudinal direction. In the cylinder head 2, a pair of intake ports 11 and 12 opened to the combustion chamber 4 and a pair of exhaust ports 13 and 14 opened to the combustion chamber 4 are provided for each combustion chamber 4. An ellipse drawn by a dotted line in FIG. 1 indicates the approximate positions of the openings of the intake ports 11 and 12 and the approximate positions of the openings of the exhaust ports 13 and 14. In the embodiments, the side on which the intake ports 11 and 12 are located when viewed from the crankshaft in the width direction of the cylinder head 2 (the side denoted by "IN" in FIG. 1) is referred to as "intake side". Also, the side on which the exhaust ports 13 and 14 are located when viewed from the crankshaft (the side denoted by "EX" in the drawing) is referred to as "exhaust side".

The cylinder head 2 is provided with a spark plug insertion hole 15 for each combustion chamber 4, which vertically penetrates the cylinder head 2 and opens at the center of the combustion chamber 4. The circle of the spark plug insertion hole 15 drawn by a dotted line in FIG. 1 indicates the approximate position of the opening of the injector insertion hole 16. Between the intake ports 11 and 12 and a cylinder block mating surface on which the cylinder block joins a cylinder head 2, an injector insertion hole 16 is provided for each combustion chamber 4, which passes below the intake ports 11 and 12 and opens to the intake side of the combustion chamber 4. The ellipse of the injector insertion hole 16 drawn by a dotted line in FIG. 1 indicates the position of the inlet of the injector insertion hole 16 formed outside the cylinder head 2.

The cylinder head 2 includes a water jacket 6 through which cooling water flows. The water jacket 6 is formed inside the cylinder head 2 by using a core when the cylinder head 2 is cast. The shape of the core is the same as that of the water jacket 6 shown in FIG. 1. A part of the sand vent hole formed when the water jacket 6 is formed by the core is used as cooling water inlets 25 and 26 for supplying cooling water into the water jacket 6. The cooling water inlets 25 and 26 are provided outside the openings of the intake ports 11 and 12 for each combustion chamber 4.

The water jacket 6 is composed of a combustion-chamber-side water jacket **6*a* for cooling the top portion of the combustion chamber 4 and its periphery, and an exhaust-side water jacket 6*b* for cooling the periphery of the exhaust ports 13 and 14. The intake ports 11 and 12 are cooled by the combustion-chamber-side water jacket 6*a***.

The combustion-chamber-side water jacket **6*a* includes a plurality of cooling water flow paths 20, 21, 22, and 23 extending from the intake side to the exhaust side for flowing cooling water from the cooling water inlets 25 and 26 to the exhaust-side water jacket 6*b* through the sides of the intake ports 11 and 12. The cooling water flow paths 20, 21, 22, and 23 include a inter-chambers flow path 21 passing between adjacent combustion chambers 4 and 4, end flow paths 22 and 23 passing between the each end of the cylinder head 2 and the outer combustion chamber 4, and an inter-ports flow path 20 passing between the pair of the intake ports 11 and 12 communicating with the common combustion chamber 4. However, the inter-ports flow path 20 is connected to the cooling water inlets 25 and 26 by communication passages 27 and 28 formed between the intake ports 11 and 12 and the injector insertion hole 16. Arrow lines extending from the cooling water inlets 25 and 26 in FIG. 1 indicate the flow of the cooling water introduced into the combustion-chamber-side water jacket 6*a* from the cooling water inlets 25 and 26. The cooling water flows between the intake ports 11 and 12 as well as along the outer sides of the intake ports 11 and 12. The cooling water flows around the spark plug insertion hole 15, that is, through the central portion of the combustor chamber 4, and then flows to the exhaust-side water jacket 6*b***.

Figure 2:
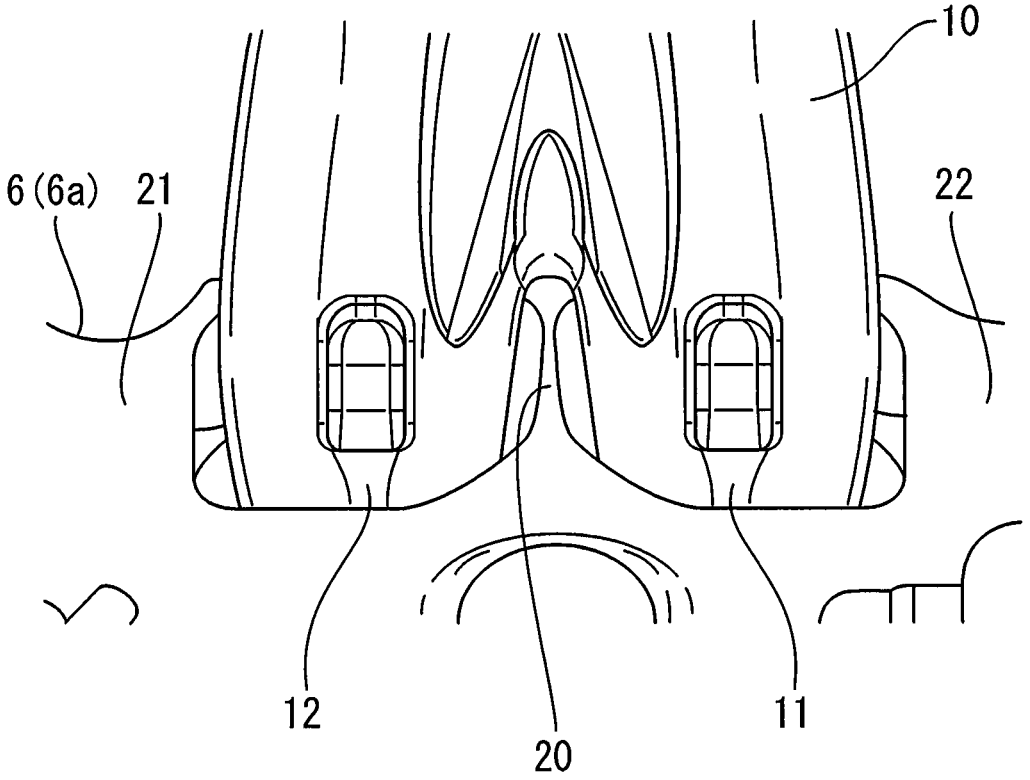
FIG. 2 is an oblique view of a configuration of the water jacket of the cylinder head near an intake port according to the first embodiment in the present disclosure.

Next, the water jacket 6, in particular, the combustion-chamber-side water jacket **6*a*, will be described in detail. FIG. 2 is an oblique view illustrating a configuration of the water jacket 6 in the vicinity of the intake ports 11 and 12. In FIG. 2, inner wall surface of port walls of the intake ports 11 and 12** are illustrated. The gap between the intake ports 11 and 12 and the water jacket 6 in FIG. 2 corresponds to the port wall of the intake ports 11 and 12, and the width of the gap indicates the wall thickness of the port wall. In the present embodiment, one intake passage 10 is bifurcated in the cylinder head to form the pair of the intake ports 11 and 12. The inter-ports flow path 20 is formed so as to pass in crotch portion at which the intake passages 10 branched into the pair of the intake ports 11 and 12.

Figure 3:
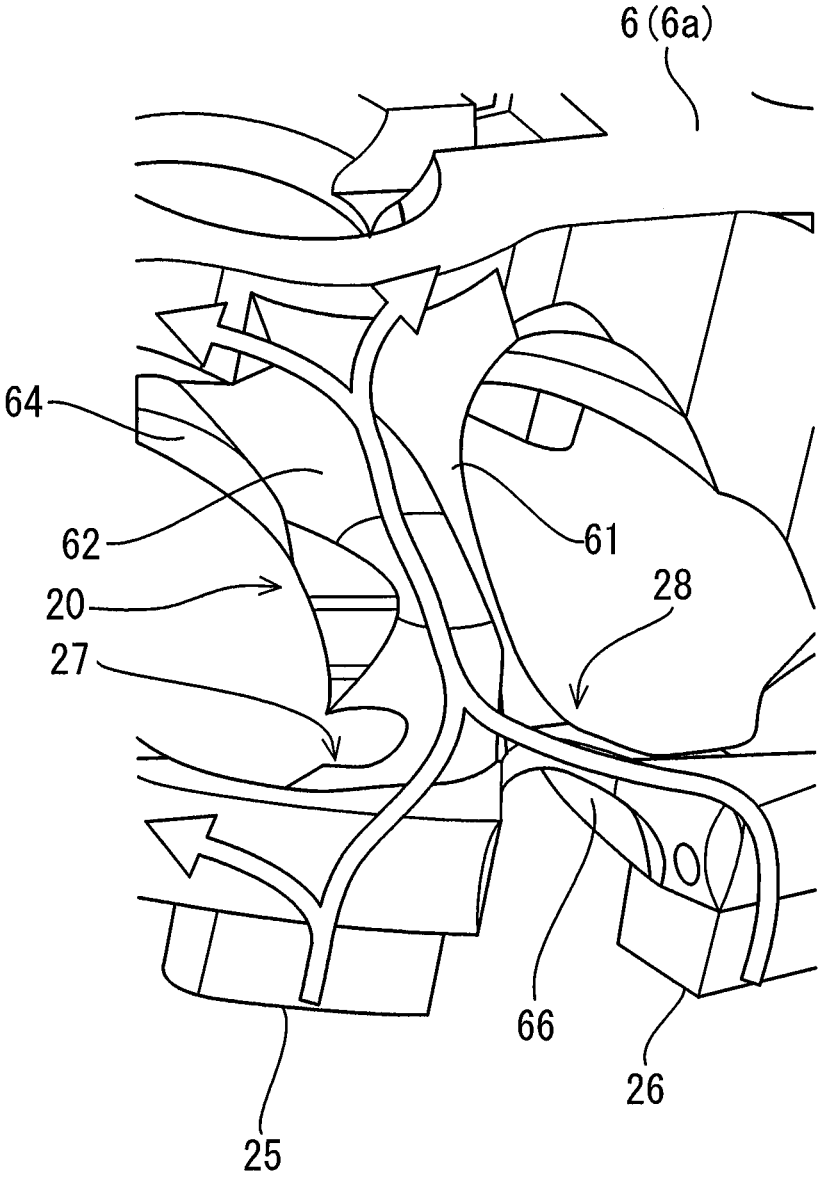
FIG. 3 is an oblique view illustrating a configuration of and flow of cooling water in an inter-ports flow path of a water jacket of the cylinder head according to the first embodiment in the present disclosure.
Figure 4:
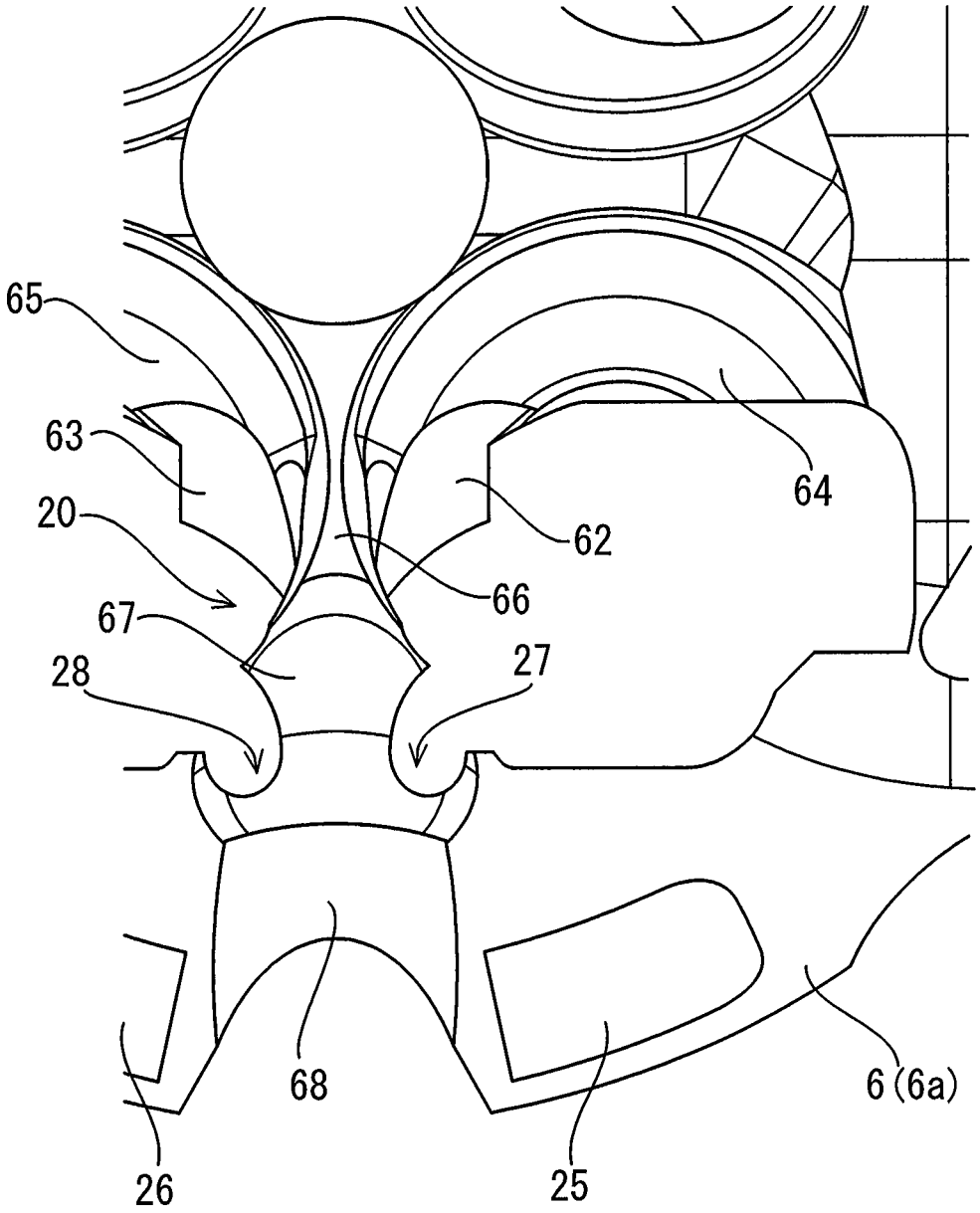
FIG. 4 is a bottom view of configuration of the inter-ports flow path of the water jacket of the cylinder head according to the first embodiment in the present disclosure.

FIG. 3 is an oblique view illustrating the configuration of the inter-ports flow path 20 of the water jacket 6 and the flow of the cooling water. FIG. 4 is a bottom view illustrating the configuration of the inter-ports flow path 20 of the water jacket 6. As shown in these figures, the inter-ports flow path 20 is formed by a plurality of wall surfaces 61, 62, 63, 64, 65, 66, and 67. The communication passages 27 and 28 are also formed by a plurality of wall surfaces 62, 63, 67, and 68. Position and shape of the wall surface 61 are determined by the position and shape of the crotch portion at which the intake passage 10 branches into the pair of the intake ports 11 and 12. The wall surfaces 62 and 63 are corresponding to the outer wall surfaces of the port walls of the intake ports 11 and 12. The wall surfaces 64 and 65 are formed along throat portions of intake valves. The wall surface 66 is formed along a pent roof of the combustion chamber 4. The wall surface 67 is formed along a cut portion for avoiding interference with the fuel spray from the direct injection injector in the combustion chamber 4. The wall surface 68 is corresponding to the outer wall surface of the hole wall of the injector insertion hole 16.

The cooling water flowing through the inter-ports flow path 20 lowers the wall surface temperature around the combustion chamber 4 and the intake ports 11 and 12, so that the increase of the compression end gas temperature is suppressed. Since the flow rate of the cooling water depends on the cross-sectional area of the inter-ports flow path 20, by making the cross-sectional area as large as possible, the increase of the compression end gas temperature is effectively suppressed. However, the shape and position of each wall surface 61-67 constituting the inter-ports flow path 20 are constrained, and the cross-sectional area of the inter-ports flow path 20 is not easily enlarged. For example, the position of the wall surface 61 which determines the height of the inter-ports flow path 20 is determined by the position of the crotch of the intake passage 10. A port injection injector (not shown) is attached to the crotch portion of the intake passage 10. Therefore, it is difficult to change the position of the wall surface 61 and increase the height of the inter-ports flow path 20 due to the constraint caused by the positional relationship between the port injection injector and the intake ports 11 and 12.

In the present embodiment, the cross-sectional area of the inter-ports flow path 20 is enlarged by enlarging the distance between the wall surfaces 62 and 63 corresponding to the outer wall surfaces of the port walls of the intake ports 11 and 12 among the wall surfaces 61 to 67 constituting the inter-ports flow path 20. More specifically, the distance between the wall surfaces 62 and 63 is increased by reducing the wall thickness of the port walls of the intake ports 11 and 12, as described below.

Figure 5:
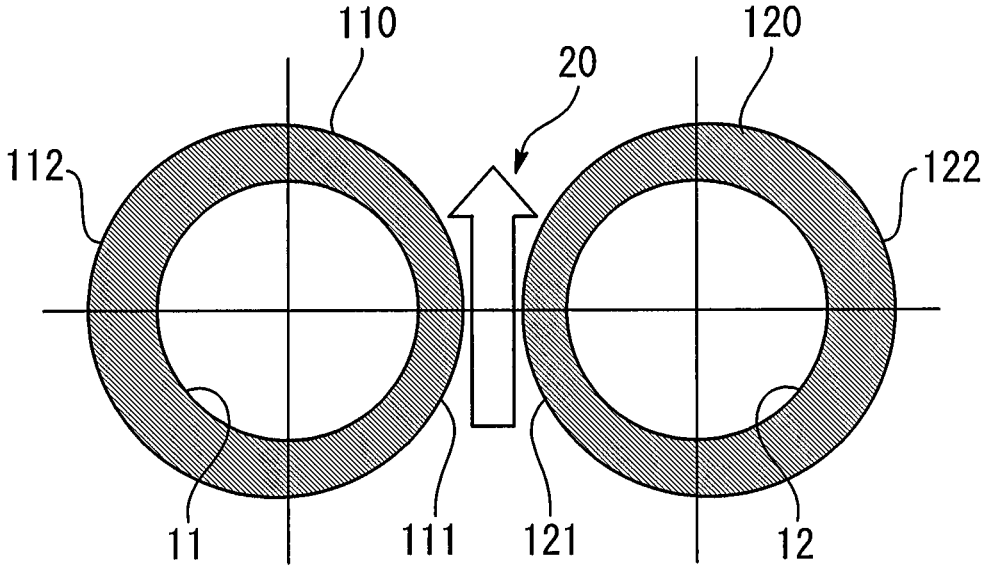
FIG. 5 is a schematic view for explaining the shape of the intake port of the cylinder head according to the first embodiment in the present disclosure.
Figure 6:
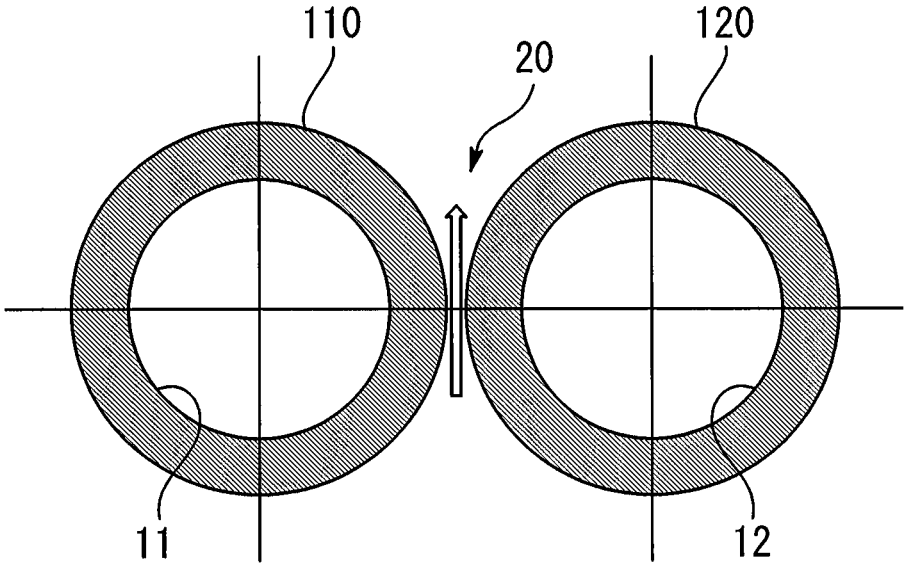
FIG. 6 is a schematic diagram of a comparative example with respect to the cylinder head according to the first embodiment in the present disclosure.

FIG. 5 is a schematic diagram for explaining the shapes of the intake ports 11 and 12 formed in the cylinder head 2. FIG. 6 is a schematic diagram of comparative example. In these figures, both the inner side and the outer side of the cross section of the intake ports 11 and 12 are schematically represented by circles. However, this is a representation for making the features of the present embodiment easy to understand, and the intake ports 11 and 12 actually has a more complicated shape.

In the comparative example shown in FIG. 6, port walls 110 and 120 of intake port 11 and 12 are formed with a uniform thickness in the peripheral direction of the intake port 11 and 12. In this case, the gap between the intake ports 11 and 12 is eliminated, and the width of the inter-ports flow path 20 cannot be increased. On the other hand, in the present embodiment shown in FIG. 5, the wall thickness of the port walls 110 and 120 of the intake ports 11 and 12 changes in the circumferential direction of the intake ports 11 and 12. More specifically, the intake ports 11 and 12 are formed to have relatively small wall thickness of the port walls 111 and 121 on the opposing sides and relatively thick wall thickness of the port walls 112 and 122 on the reversing sides. At least a part of the outer wall surfaces of the port walls 111 and 121 on the opposing sides corresponds to the wall surfaces 62 and 63 constituting the inter-ports flow path 20.

If the width of the inter-ports flow path 20 is simply made wider, the diameter of the intake ports 11 and 12 may be made smaller, or the wall thickness of the port walls 110 and 120 may be made thinner. However, in the former method, a decrease in intake air amount causes a decrease in efficiency and output. In the latter method, it becomes difficult to secure the strength of the intake ports 11 and 12 enough to withstand the explosive stress, the thermal stress, and the like from a combustion chamber 4.

With respect to such a problem, in the present embodiment, as described above, the wall thickness of the port walls 111 and 121 on the opposing sides is reduced, while the wall thickness of the port walls 112 and 122 on the reversing sides is increased. That is, instead of reducing the wall thickness in the whole port walls 110 and 120, the wall thickness of the portion related to the width of the inter-ports flow path 20 is reduced, and the wall thickness of the other portion is increased by an amount corresponding to the thinning of the portion. In addition, in the present embodiment, the wall thickness of the port walls 110 and 120 is gradually increased from the port walls 111 and 121 on the opposing sides to the port walls 112 and 122 on the reversing sides. The stress concentration can be prevented by gradually changing the wall thickness in the circumferential direction without forming a step in the wall thickness of the port walls 110 and 120.

The thinning of the wall thickness of the port walls 111 and 121 on the opposing sides has an effect that the cross-sectional area of the inter-ports flow path 20 can be increased while maintaining the opening diameters of the intake ports 11 and 12. Increasing the wall thickness of the port walls 112 and 122 on the reversing sides has the effect of maintaining the strength of the intake ports 11 and 12. That is, according to the present embodiment, it is possible to secure a flow path for flowing the cooling water between the intake ports 11 and 12 while maintaining the opening diameters and strengths of the intake ports 11 and 12.

Figure 7:
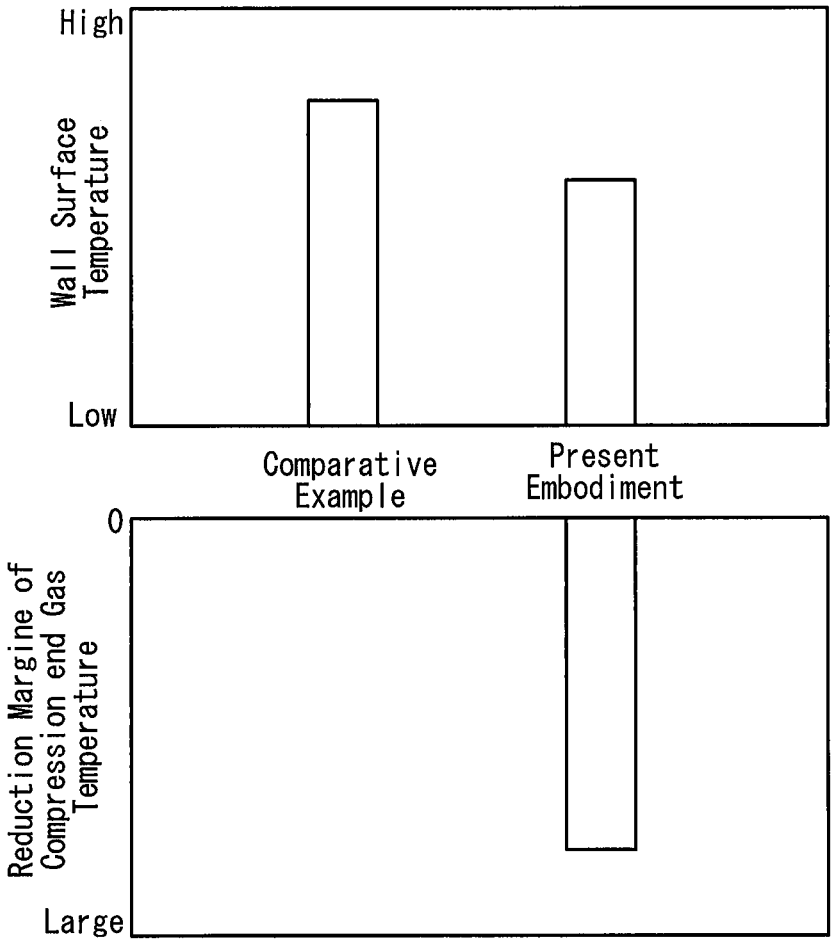
FIG. 7 is a diagram for explaining the effect of the cylinder head according to the first embodiment in the present disclosure.
Figure 8:
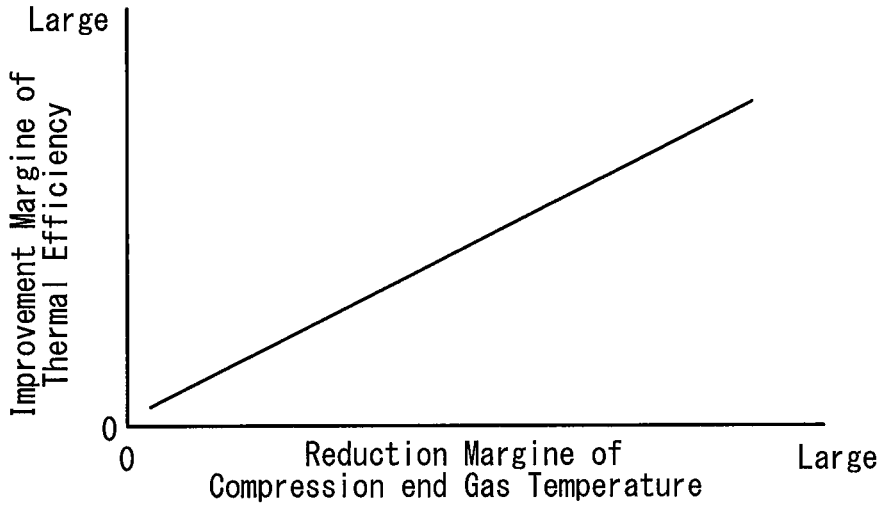
FIG. 8 is a diagram illustrating the relationship between the reduction margin of the compression end gas temperature and improvement margin of the thermal efficiency.

FIG. 7 is a diagram for explaining the effect of the present embodiment. According to the present embodiment, since the cross-sectional area of the inter-ports flow path 20 can be made larger than that of the comparative example, the flow rate of the cooling water flowing between the intake ports 11 and 12 is ensured. Consequently, as shown in the upper graph in FIG. 7, the wall surface temperatures of the combustion chamber 4 and the intake ports 11 and 12 of the present embodiment is suppressed to be lower than those of the comparative example. Accordingly, as shown in the lower graph in FIG. 7, according to the present embodiment, the compression end gas temperature can be reduced as compared with the comparative example. FIG. 8 is a diagram showing the relationship between the reduction margin of the compression end gas temperature and the improvement margin of the thermal efficiency. According to the present embodiment, the thermal efficiency is improved by reducing the compression end gas temperature.

Second Embodiment

Second embodiment in the present disclosure will be described with reference to the drawings.

As described in the first embodiment, the inter-ports flow path 20 is connected to the cooling water inlets 25 and 26 by the communication passages 27 and 28 formed between the intake ports 11 and 12 and the injector insertion hole 16. Therefore, the flow rate of the cooling water flowing through the inter-ports flow path 20 depends on the ease of flow of the cooling water in the communication passages 27 and 28.

As described with reference to FIGS. 3 and 4, the communication passages 27 and 28 are formed by the plurality of the wall surfaces 62, 63, 67, and 68. Among these wall surfaces 62, 63, 67 and 68, the distance between the wall surfaces 62 and 63 is enlarged by reducing the wall thickness of the corresponding port walls 111 and 121 of the intake ports 11 and 12. In the present embodiment, the height of the wall surface 68 corresponding to the outer wall surface of the hole wall of the injector insertion hole 16 is further reduced, thereby enlarging the cross-sectional area of the communication passages 27 and 28.

Figure 9:
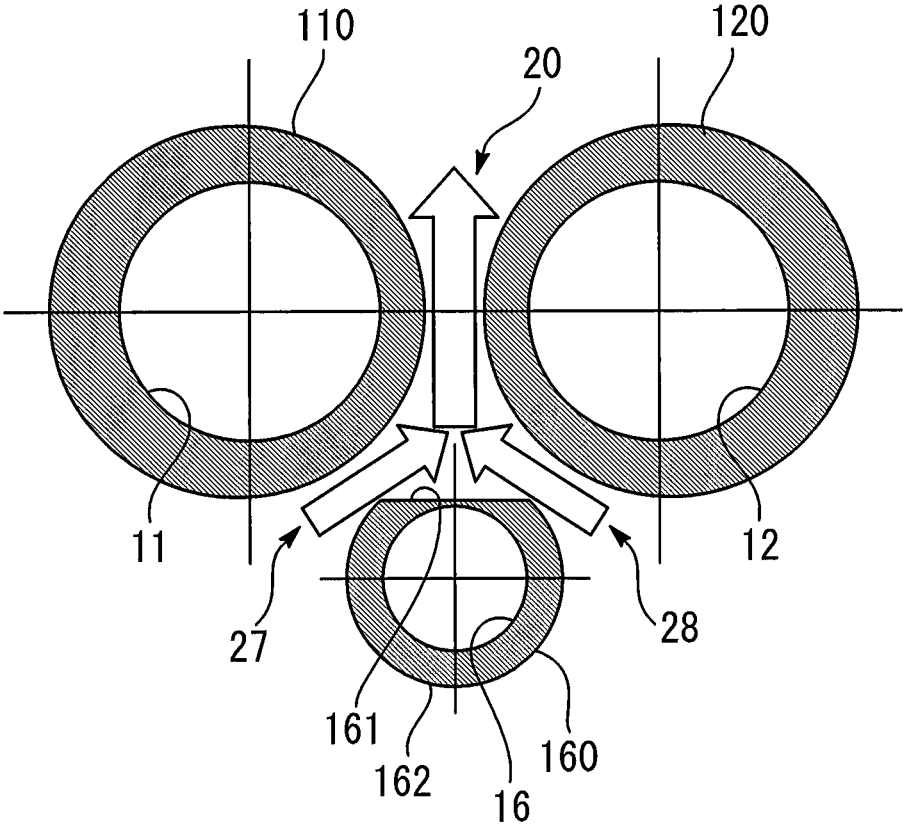
FIG. 9 is a schematic view for explaining the shape of the injector insertion hole of the cylinder head according to the second embodiment in the present disclosure.
Figure 10:
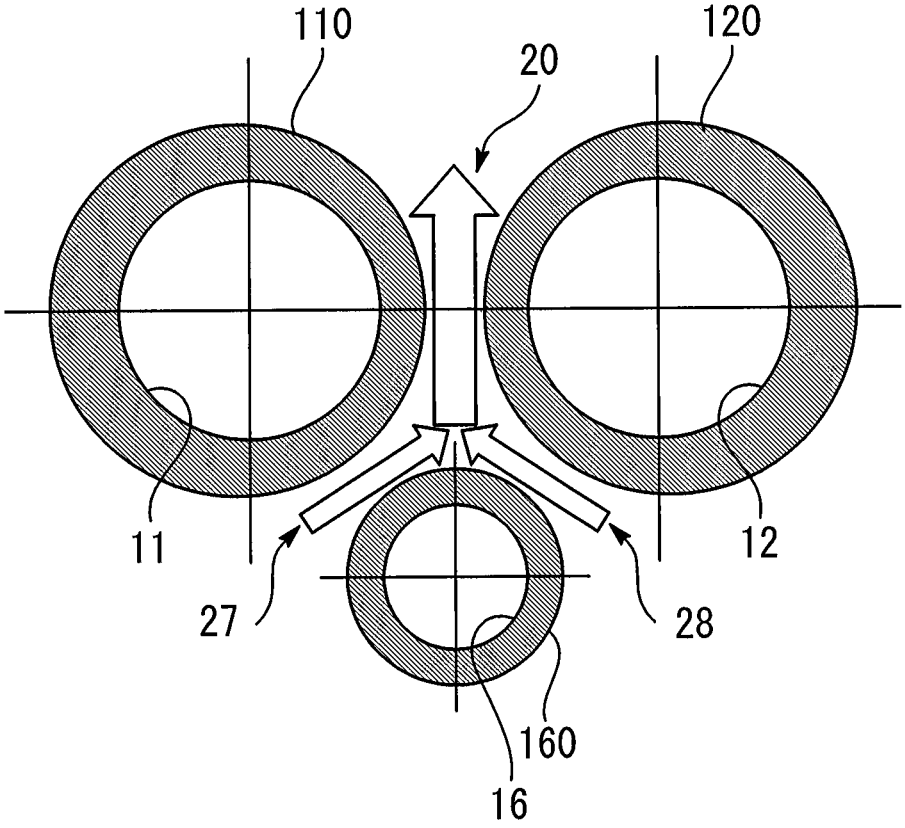
FIG. 10 is a schematic diagram showing a comparative example with respect to second embodiment in the present disclosure.

FIG. 9 is a schematic view for explaining the shape of the injector insertion hole 16 formed in the cylinder head 2 of the present embodiment. FIG. 10 is a schematic view of comparative example. In the comparative example shown in FIG. 10, a hole wall 160 of a injector insertion hole 16 is formed to have a uniform thickness in the circumferential direction of the injector insertion hole 16. In contrast, in the present embodiment shown in FIG. 9, the wall thickness of the hole wall 160 of the injector insertion hole 16 is not uniform in the circumferential direction of the injector insertion hole 16. Specifically, by cutting a part of the outside of the hole wall 161 flat, the hole wall 161 of the injector insertion hole 16 on the side facing the intake ports 11 and 12 is made thinner than the hole wall 162 on the side facing away from the intake ports 11 and 12. As can be understood from a comparison between FIG. 9 and FIG. 10, by thinning the hole wall 161 on the side facing the intake ports 11 and 12, the height of the wall surface 68 constituting the communication flow paths 27 and 28 is lowered, and the cross-sectional areas of the communication passages 27 and 28 are enlarged.

Figure 11:
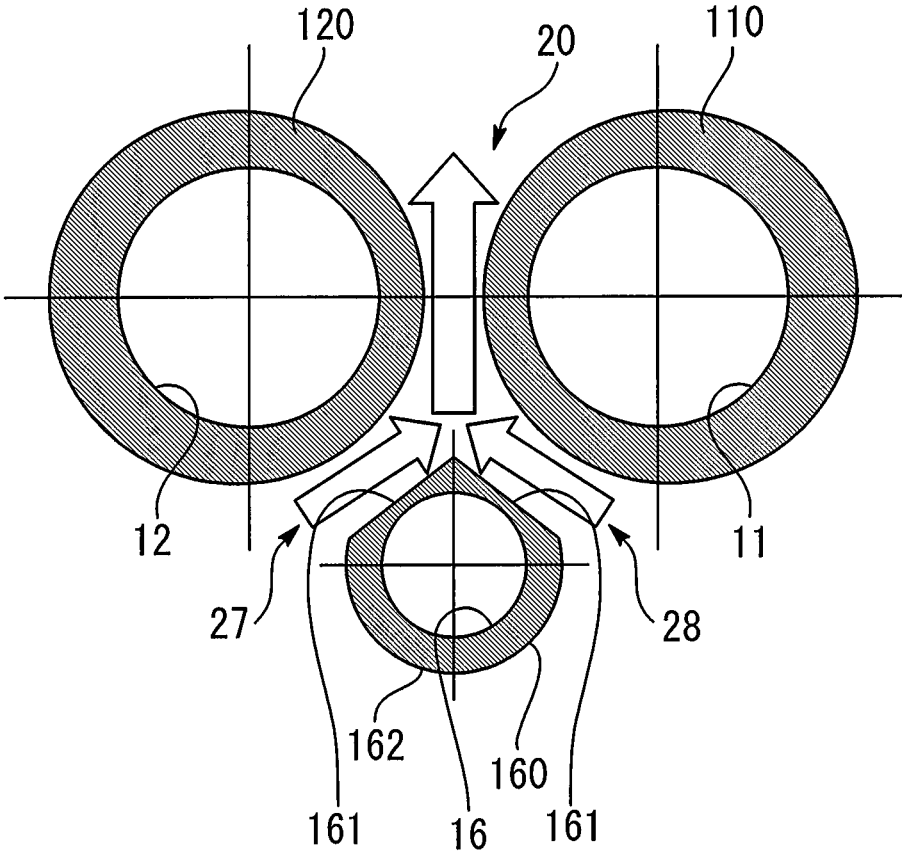
FIG. 11 is a schematic view for explaining a modification of the shape of the injector insertion hole of the cylinder head according to the second embodiment in the present disclosure.

FIG. 11 is a schematic view for explaining a modification of the shape of the injector insertion hole 16 formed in the cylinder head 2 of the present embodiment. In FIG. 11, the hole wall 161 of the injector insertion hole 16 on the side facing the intake ports 11 and 12 is cut obliquely so as to face the each intake ports 11 and 12. The wall thickness thereof is made thinner than the hole wall 162 on the side facing away from the intake ports 11 and 12. Although not shown, the thickness of the hole wall 160 may be gradually reduced from the hole wall 162 on the side facing away from the intake ports 11 and 12 to the hole wall 161 on the side facing the intake ports 11 and 12.

What is claimed is:

1. A cylinder head of an internal combustion engine comprising:

a pair of intake ports communicating with a combustion chamber; and an inter-ports flow path for flowing cooling water formed between port walls on opposing sides of the pair of the intake ports, wherein, wall thickness of the port walls on the opposing sides is thinner than wall thickness of the port walls on reversing side of the pair of the intake ports, the opposing side is the side on which the port walls of the pair of the intake ports face each other, the reversing side is the side opposite to the opposing side and is the side on which the port walls of the pair of the intake ports face away from each other, and the wall thickness of each the port walls gradually increases from the opposing side to the reversing side.

2. The cylinder head according to claim 1, wherein the pair of the intake ports are parts of an intake passage into which the intake passage bifurcates in the cylinder head, and the inter-ports flow path is formed in a gap between a crotch at which the intake passage bifurcates into the pair of the intake ports and the combustion chamber.

3. A cylinder head of an internal combustion engine comprising:

a pair of intake ports communicating with a combustion chamber;

an inter-ports flow path for flowing cooling water formed between port walls on opposing sides of the pair of the intake ports;

an injector insertion hole provided between the pair of the intake ports and a cylinder block mating surface and communicating with the combustion chamber; and a communication passage for introducing the cooling water into the inter-ports flow path formed between the pair of the intake ports and the injector insertion hole, wherein a wall thickness of the port walls on the opposing sides is thinner than a wall thickness of the port walls on reversing side of the pair of the intake ports, the opposing side is the side on which the port walls of the pair of the intake ports face each other, the reversing side is the side opposite to the opposing side and is the side on which the port walls of the pair of the intake ports face away from each other, and a wall thickness of a hole wall of the injector insertion hole on the side facing the pair of the intake ports is thinner than the wall thickness of the hole wall of the injector insertion hole on the side facing away from the pair of the intake ports.

4. The cylinder head according to claim 3, wherein the pair of the intake ports are parts of an intake passage into which the intake passage bifurcates in the cylinder head, and the inter-ports flow path is formed in a gap between a crotch at which the intake passage bifurcates into the pair of the intake ports and the combustion chamber.

* * * * *